US006374522B1

(12) United States Patent
Lo

(10) Patent No.: US 6,374,522 B1
(45) Date of Patent: Apr. 23, 2002

(54) GLASS WATER BALL STRUCTURE

(75) Inventor: Szu Wei Lo, Taichung (TW)

(73) Assignee: Single-Tree Art Industry Co., Ltd., Taichung (TW)

( * ) Notice: Subject to any disclaimer, the term of this patent is extended or adjusted under 35 U.S.C. 154(b) by 65 days.

(21) Appl. No.: 09/624,031

(22) Filed: Jul. 24, 2000

(51) Int. Cl.[7] ..... G09F 19/00

(52) U.S. Cl. ..... 40/410; 40/411; 40/473; 446/267

(58) Field of Search ..... 40/473, 410, 409, 40/411, 406, 407; 446/267

(56) References Cited

U.S. PATENT DOCUMENTS 6,027,774 A * 2/2000 Fine ..... 40/410

* cited by examiner

*Primary Examiner*—Alexander S. Thomas
(74) *Attorney, Agent, or Firm*—Rosenberg, Klein & Lee

(57) ABSTRACT

A glass water ball structure including a base seat having a receptacle in which a fixing seat of the glass water ball is received. A lower support cone is disposed on the fixing seat of the glass water ball to abut against an adjusting bolt screwed in the base seat. An upper support cone is disposed on the dome of the glass water ball to abut against a frame body upward extending from the base seat. The entire glass water ball is pivotally disposed in the base seat.

4 Claims, 4 Drawing Sheets

GLASS WATER BALL STRUCTURE

BACKGROUND OF THE INVENTION

The present invention relates to an improved glass water ball structure, and more particularly to a glass water ball structure which has high safety and little frictional force against rotation and can be rotated for a long time.

FIG. 4 shows a conventional glass water ball 8 including a base seat 81 and a glass ball 82 fixed on the base seat 81. When it is desired to watch the decorative articles disposed in the glass ball 82 from different angles, it is necessary to turn the entire base seat 81. This is inconvenient to a user.

Moreover, in some products, numerous fine decorative chips are added into the glass ball 82. When shaking the glass water ball 8, the liquid contained therein will be disturbed and the decorative chips will be entrained by the liquid and finally slowly fall down as snow. With respect to a larger or a heavier glass water ball 8, it is dangerous to shake the glass water ball 8. In case the glass water ball 8 is incautiously dropped, the user may get hurt.

Although some kinds of articles such as terrestrial globes can be rotatably supported at two ends, it is impossible to insert a supporting pin or shaft into or pass the supporting pin or shaft through the glass water ball 8. Therefore, such rotary measure cannot be transferred to the glass water ball 8.

SUMMARY OF THE INVENTION

It is therefore a primary object of the present invention to provide a glass water ball structure in which a fixing seat of the glass water ball is received in a receptacle of the base seat. An upper support cone of the dome of the glass water ball and a lower support cone of the bottom of the fixing seat respectively abut against a frame body and an adjusting bolt screwed in the base seat. Therefore, the entire glass water ball is firmly pivotally disposed in the base seat and can be rotated with safety ensured.

It is a further object of the present invention to provide the above glass water ball in which by means of adjusting the adjusting bolt screwed in the base seat, the frictional force against the rotation of the glass water ball between the upper and lower support cones and the bottom face of the frame body and the top face of the adjusting bolt can be minimized so that the glass water ball can be rotated for a long time.

According to the above objects, the glass water ball structure of the present invention includes a base seat having a receptacle with an opening facing upward. A fixing seat of a bottom of a transparent glass water ball is received in the receptacle. A liquid and decorative article are contained in the glass water ball. The bottom of the base seat is formed with a thread hole communicating with the receptacle. An adjusting bolt is screwed in the thread hole. The fixing seat of the glass water ball is disposed with a lower support cone. The lower support cone abuts against a top face of the adjusting bolt. A frame body is disposed on the base seat and extending to upper side of the glass water ball. An upper support cone is adhered to the dome of the glass water ball. The upper support cone abuts against the bottom face of the frame body.

The present invention can be best understood through the following description and accompanying drawings wherein:

DETAILED DESCRIPTION OF THE PREFERRED EMBODIMENTS

Figure 1:
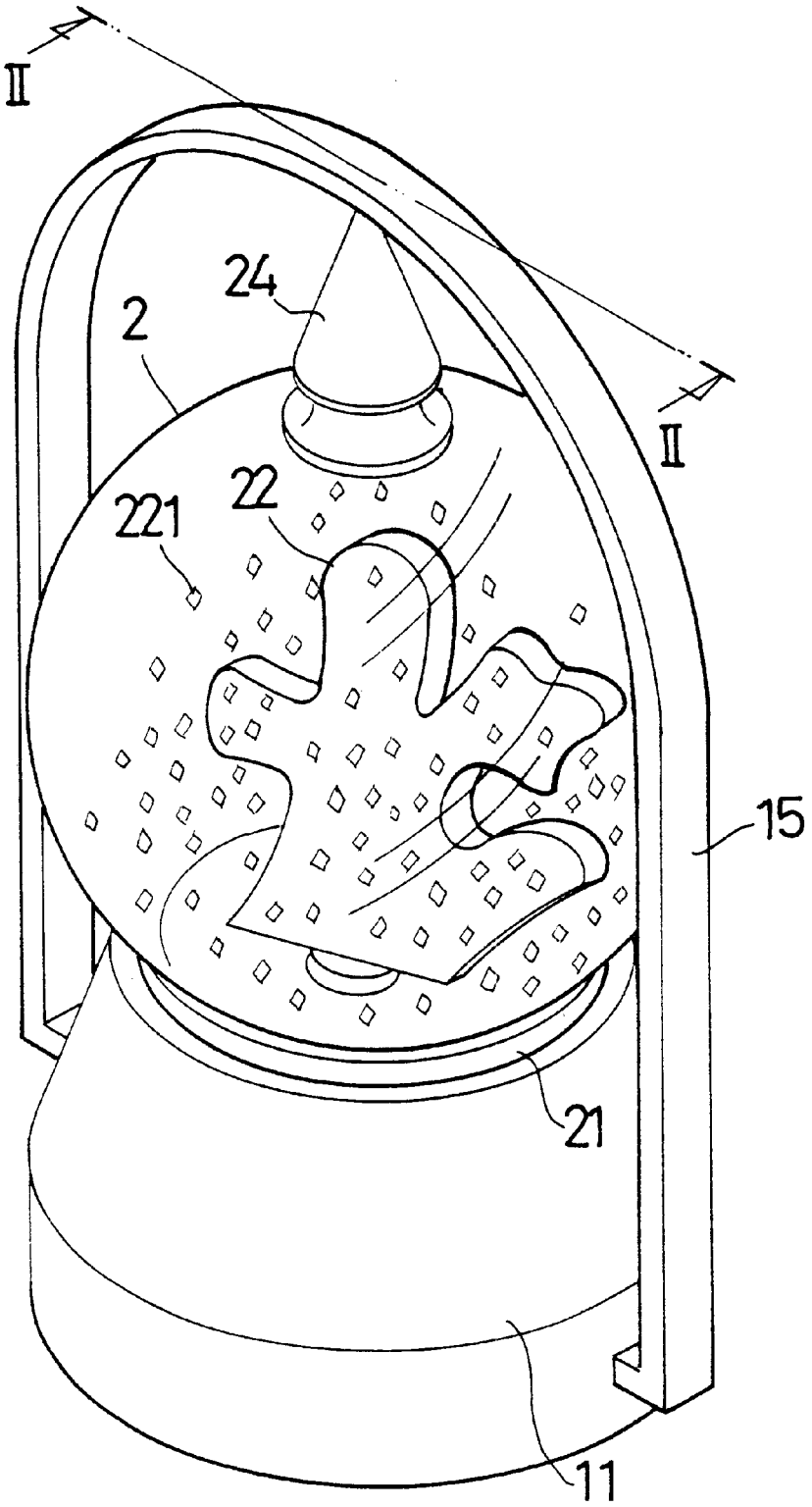
FIG. 1 is a perspective view of the present invention.
Figure 2:
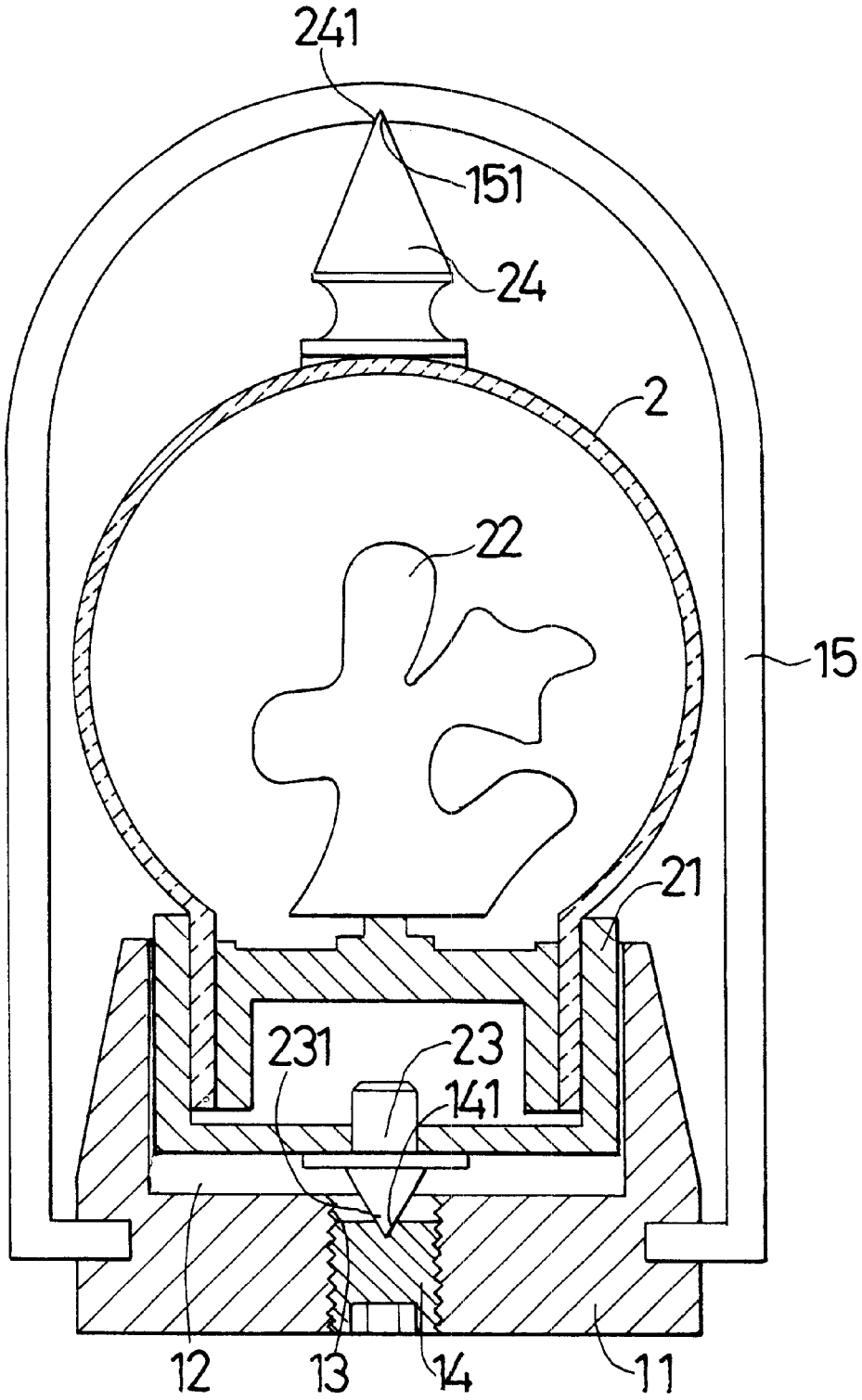
FIG. 2 is a sectional view taken along line II—II of FIG. 1.

Please refer to FIGS. 1 and 2. According to a first embodiment, the glass water ball structure of the present invention includes a base seat 11 having a receptacle 12 with an opening facing upward. A fixing seat 21 of the bottom of a transparent glass water ball 2 is received in the receptacle 12. A liquid, decorative article 11 and numerous fine decorative chips 221 are contained in the glass water ball 2. The bottom of the base seat 11 is formed with a thread hole 13 communicating with the receptacle 12. An adjusting bolt 14 is screwed in the thread hole 13. The fixing seat 21 of the glass water ball 2 is disposed with a lower support cone 23. The top face of the adjusting bolt 14 is formed with a first locating hole 141 corresponding to the tip 231 of the lower support cone 23 in which the lower support cone 23 is retained. A frame body 15 is disposed on the base seat 11, surrounding the upper side of the glass water ball 2. An upper support cone 24 is adhered to the dome of the glass water ball 2. The upper and lower support cones 24, 23 are coaxially arranged. The bottom face of the frame body 15 is formed with a second locating hole 151 corresponding to the tip 241 of the upper support cone 24 in which the upper support cone 24 is retained. The decorative article 21 contained in the glass water ball 2 has an asymmetrical pattern with respect to the rotary axis of the glass water ball 2.

When assembled, the fixing seat 21 of the glass water ball 2 is positioned in the receptacle 12 of the base seat 11 and then the adjusting bolt 14 is screwed to lift the lower support cone 23 and move the entire glass water ball 2 upward until the upper support cone 24 abuts against the frame body 15. Therefore, the entire glass water ball 2 is safely and firmly pivotally disposed in the base seat 11. Accordingly, the glass water ball 2 will not drop and damage during assembling procedure.

The lower support cone 23 of the fixing seat 21 of the glass water ball 2 is retained in the first locating hole 131 of the adjusting bolt 13 of the base seat 11, while the upper support cone 24 of the glass water ball 2 is retained in the second locating hole 151 of the bottom face of the frame body 15. Therefore, there are only two contact points between the glass water ball 2 and the frame body 15 and the adjusting bolt 13. Moreover, by means of adjusting the adjusting bolt 13, the contacting force between the upper and lower support cones 24, 23 and the frame body 15 and the adjusting bolt 13 can be varied to minimize the frictional force against the rotation of the glass water ball 2. Accordingly, a user only needs to apply little force for turning the glass water ball 2. Furthermore, due to the little frictional force against the rotation, in case the user turns the glass water ball 2 with greater force, the glass water ball 2 will rotate for a long time. Therefore, the user can conveniently see the decorative article 22 from different angles. The decorative article 22 can be designed with different patterns in cooperation with the rotary glass water ball 2 to form a dynamic visual effect.

Moreover, prior to rotation, the liquid contained in the glass water ball 2 is inertially still. However, after the glass water ball 2 is rotated, the asymmetrical decorative article 21 will rotate along with the glass water ball 2. As a result, the liquid in the glass water ball 2 will be disturbed to carry the decorative chips 221 to flow around. Finally, the decorative chips 221 will slowly fall down due to their own weight to achieve a visual effect as snowing in the rotary glass water ball 2. Therefore, it is unnecessary to shake the entire glass water ball for disturbing the liquid as the conventional glass water ball so that the safety in use can be ensured.

In addition, in case the upper support cone 24 accidentally detach from the second locating hole 151 of the frame body 15 in use, the fixing seat 21 of the glass water ball 2 is still received in the receptacle 12 of the base seat 11 so that the glass water ball 2 will be still stably seated in the base seat 11 without dropping.

Figure 3:
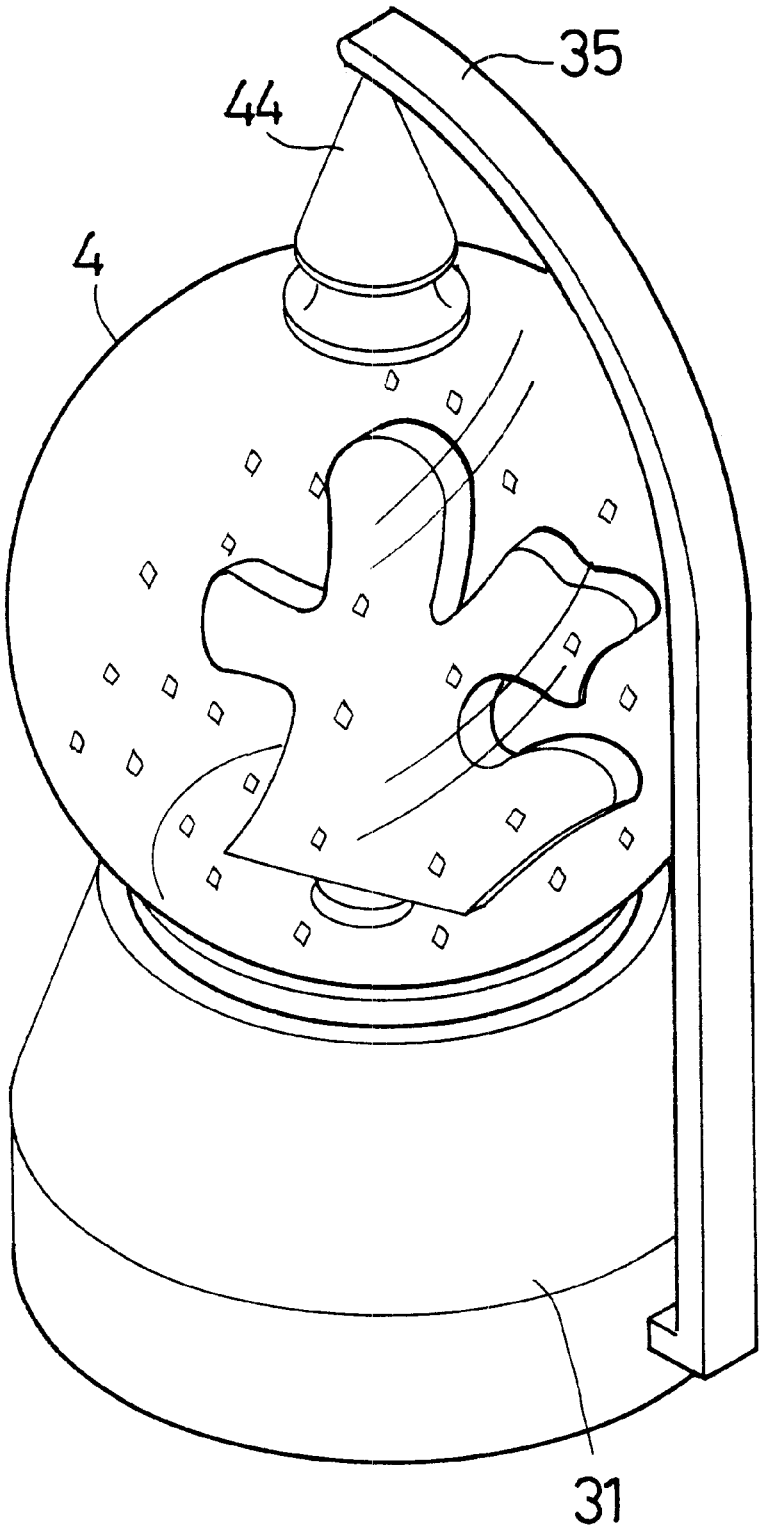
FIG. 3 is a perspective view of a second embodiment of the present invention.
Figure 4:
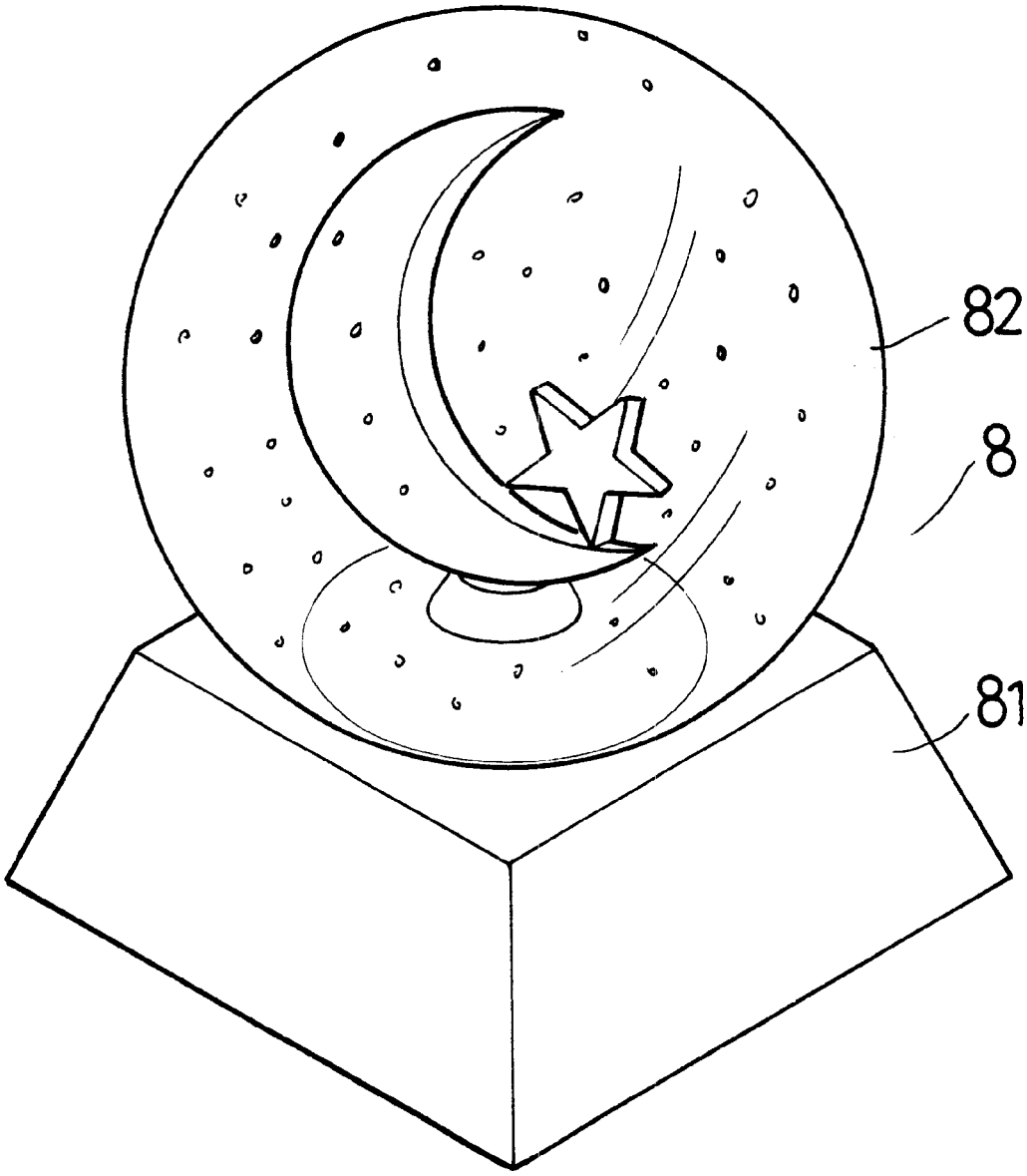
FIG. 4 PRIOR ART
FIG. 4 is a perspective view of a conventional glass water ball.

FIG. 3 shows a second embodiment of the present invention, in which the frame body 35 upward extends from the base seat 31 to the upper side of the glass water ball 4 for the upper support cone 44 of the glass water ball 4 to abut against. Such structure achieves the same effect as the first embodiment.

The above embodiments are only used to illustrate the present invention, not intended to limit the scope thereof. Many modifications of the above embodiments can be made without departing from the spirit of the present invention.

What is claimed is:

1. A glass water ball structure comprising a base seat having a receptacle with an opening facing upward, a fixing seat of a bottom of a transparent glass water ball being received in the receptacle, a liquid and decorative article being contained in the glass water ball, the bottom of the base seat being formed with a thread hole communicating with the receptacle, an adjusting bolt being screwed in the thread hole, the fixing seat of the glass water ball being disposed with a lower support cone, the lower support cone abutting against a top face of the adjusting bolt, a frame body being disposed on the base seat and extending to upper side of the glass water ball, an upper support cone being adhered to the dome of the glass water ball, the upper and lower support cones being coaxially arranged, the upper support cone abutting against the bottom face of the frame body.

2. A glass water ball structure as claimed in claim 1, wherein the top face of the adjusting bolt is formed with a first locating hole corresponding to a tip of the lower support cone.

3. A glass water ball structure as claimed in claim 1, wherein the bottom face of the frame body is formed with a second locating hole corresponding to a tip of the upper support cone.

4. A glass water ball structure as claimed in claim 1, wherein the decorative article contained in the glass water ball has an asymmetrical pattern with respect to the rotary axis of the glass water ball and numerous fine decorative chips are contained in the glass water ball.

* * * * *